United States Patent [19]

Schwarz et al.

[11] Patent Number: 4,576,496

[45] Date of Patent: Mar. 18, 1986

[54] DEVICE FOR GUIDING A PRINT ELEMENT

[75] Inventors: Helmut Schwarz, Dachau; Heinz Stickel, Groebenzell, both of Fed. Rep. of Germany

[73] Assignee: Siemens Aktiengesellschaft, Berlin & Munich, Fed. Rep. of Germany

[21] Appl. No.: 586,986

[22] Filed: Mar. 7, 1984

[30] Foreign Application Priority Data

Apr. 12, 1983 [DE] Fed. Rep. of Germany ..... 3313205

[51] Int. Cl.[4] ..... B41J 19/00; B41J 11/22

[52] U.S. Cl. ..... 400/352; 400/320; 400/354; 400/356

[58] Field of Search ..... 400/352, 354, 354.1, 400/175, 320, 144.2, 660, 693.1, 335, 283, 353, 354.2, 355, 356, 357, 674

[56] References Cited

U.S. PATENT DOCUMENTS

| | | | |
|---|---|---|---|
| 2,999,578 | 9/1961 | Holden | 400/693.1 X |
| 4,222,673 | 9/1980 | Plaza et al. | 400/352 X |
| 4,299,502 | 11/1981 | Harre | 400/175 X |
| 4,351,383 | 9/1982 | Gladwin | 164/448 |
| 4,352,668 | 10/1982 | Beevers et al. | 114/344 |
| 4,360,980 | 11/1982 | Jarvis | 37/117.5 |
| 4,381,896 | 5/1983 | Shiurla | 400/352 X |
| 4,444,519 | 4/1984 | Howell et al. | 400/144.2 X |
| 4,452,542 | 6/1984 | Akazawa | 400/354 X |
| 4,468,143 | 8/1984 | Volke et al. | 400/352 X |
| 4,468,144 | 8/1984 | McMahon et al. | 400/354 |
| 4,472,071 | 8/1984 | Blomquist et al. | 400/354 X |
| 4,475,826 | 10/1984 | Durr et al. | 400/352 X |

FOREIGN PATENT DOCUMENTS

| | | | |
|---|---|---|---|
| 0020996 | 1/1981 | European Pat. Off. | 400/352 |
| 3136192 | 3/1983 | Fed. Rep. of Germany | 400/660 |
| 0069058 | 4/1983 | Japan | 400/352 |
| 7510453 | 3/1976 | Netherlands | 400/693.1 |
| 1388335 | 3/1975 | United Kingdom . | |

OTHER PUBLICATIONS

IBM Tech. Disc. Bulletin, "Belt System for Printer Carrier", Greenlief et al., vol. 25, No. 10, Mar. 1983, pp. 5379–5380.

IBM Tech. Disc. Bulletin, "Typehead Carrier Clamp", Rhodes, vol. 15, No. 8, Jan. 1973, pp. 2471–2472.

IBM Tech. Disc. Bulletin, "Latch", Habich et al., vol. 21, No. 10, Mar. 1979, pp. 3878–3879.

Xerox Disc. Journal, "Print Wheel Removal Assist Means", Frechette, vol. 4, No. 2, Mar./Apr. 1979, pp. 175–176.

IBM Tech. Disc. Bulletin, "Two-piece Snap-on Over-Center Latch", Kinney et al., vol. 24, No. 3, Aug. 1981, pp. 1422–1423.

*Primary Examiner*—Edgar S. Burr

*Assistant Examiner*—James R. McDaniel

*Attorney, Agent, or Firm*—Hill, Van Santen, Steadman & Simpson

[57] ABSTRACT

A device is provided for guiding a print element of a printer device. The guide device comprises a guide bushing which is provided with two sliding surfaces and which is carried on a guide rail facing the platen. A support mount is engaged over the guide bushing and has a projection for fastening a traction device, such as a toothed belt, of a drive system. The support mount also has latch openings for receiving latch pieces for accurate positioning of the print element. The print element further comprises a fork-like guide projection to be received over and for sliding along a second guide rail. In order to fasten the print element to the guide bushing, a resilient snap-in clip is held constantly locked at the print element, the snap-in clip being pivotal so as to partially embrace the guide bushing and has projecting ends which are freely accessible for unlatching of the clip.

9 Claims, 2 Drawing Figures

DEVICE FOR GUIDING A PRINT ELEMENT

BACKGROUND OF THE INVENTION

1. Field of the Invention

The present invention relates to a device for guiding a print element which is seated on two guide rails so as to be longitudinally movable, whereby the motion of the print element along a line of a recording medium occurs by way of a driven traction element.

2. Description of the Prior Art

It is generally known in typing and printing devices to provide a so-called printer carriage which carries the actual printing element. The printer carriage represents a self-contained assembly and is moved back and forth on two guide rails parallel to the platen, i.e. along a line of a recording medium. The motion occurs by way of a traction device, for example by way of a toothed belt, that is positively and non-positively locked to the printer carriage at the underside thereof. The print element, for example a print head, can either be a fixed component of the printer carriage or can be interchangeably connected to the printer carriage. A printer device of this type is disclosed, for example, in the German allowed and published application No. 22 32 590.

A printer carriage of the type described above represents a compact, structurally involved and relatively heavy assembly that, particularly given high printing speeds, requires considerable forces in the acceleration and the deceleration of the printer carriage.

SUMMARY OF THE INVENTION

The object of the present invention is to provide a device for guiding a print element that is simple in structure, whose weight and volume are considerably reduced, and wherein the interchangeability of the actual print element is simplified. The above object is achieved in a device of the general type set forth above and is characterized in that a guide bushing is slidingly movable on a guide rail facing the recording medium and is provided with a support mount engaged thereabove, in that the support mount comprises a projection for fastening the traction device and latch openings which position the print element together with latch pieces at the print element, in that the print element exhibits a fork-like guide projection that can be plugged onto a second guide rail, and in that the print element is secured to the guide bushing by way of a latch element.

More specifically, the latch element is advantageously designed as a resilient snap-in clip that is held positively locked in the print element and whose lateral arms partially embrace the guide bushing after the print element has been plugged onto the second guide rail and has been positioned.

Advantageously, the guide bushing is designed as a bronze bushing having two glide surfaces.

It is of further advantage that the support mount which is latchable to the first-mentioned guide rail is a plastic element to which the traction device is secured by way of a releasable connection, preferably by way of a turnbuckle.

The advantages of the present invention reside in a particularly low expense structural design, whereby noticeably lower accelerating and decelerating forces occur in the motion sequence of the printer device due to the reduction in weight and volume which is attainable therewith. This reduction not only promotes a desired miniaturization of the overall structure, but also has a beneficial influence on the printing speeds.

BRIEF DESCRIPTION OF THE DRAWING

Other objects, features and advantages of the invention, its organization, construction and operation will be best understood from the following detailed description, taken in conjunction with the accompanying drawing, on which.

DESCRIPTION OF THE PREFERRED EMBODIMENTS

Figure 1:
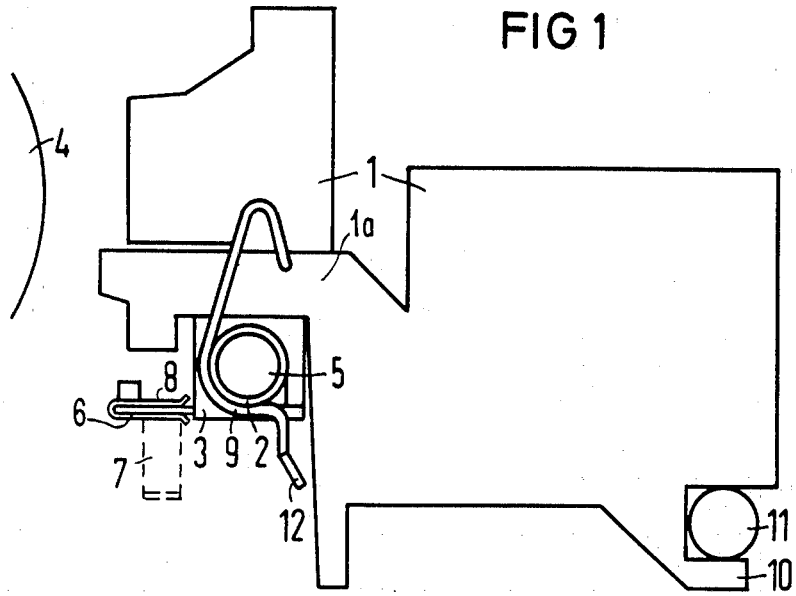
FIG. 1 is a side view of a print device constructed in accordance with the present invention.

The exemplary embodiment illustrated on the drawing shows only those parts of a print device that are necessary for an understanding of the invention. The device provided for guiding a print head 1 including a cross-bar 1*a* comprises a guide bushing 2 and a support mount 3 engaged thereover. The guide bushing 2 is plugged onto a guide rail 5 facing a platen 4 and is slidably movable thereon. The support mount 3 comprises a projection 6 to which a traction device 7, for example a toothed belt, is attached. To this end, a clip 8 is provided in the present example. The guide bushing 2 and the support 3 are moved back and forth in front of the platen 4 in a line direction via drive elements (not illustrated) for example by way of stepping motors. The support mount 3 also comprises latch openings which, together with corresponding latch pieces disposed on the print head, guarantee an accurate positioning of the print head in a simple manner. Details with respect thereto shall be explained with reference to FIG. 2. The design of the guide bushing 2 as a bronze bushing having two gliding faces assures that the guide bushing 2 runs on the guide rail 5 with very low play so that high demands made of the print quality are also assured, these depending to a rather considerable degree on a very precise guidance of the print head.

Figure 2:
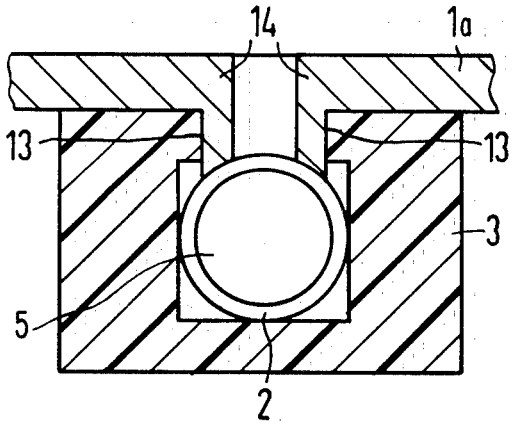
FIG. 2 is an enlarged sectional view of a portion of the apparatus of FIG. 1 particularly illustrating the latch mechanism.
Figure 3:
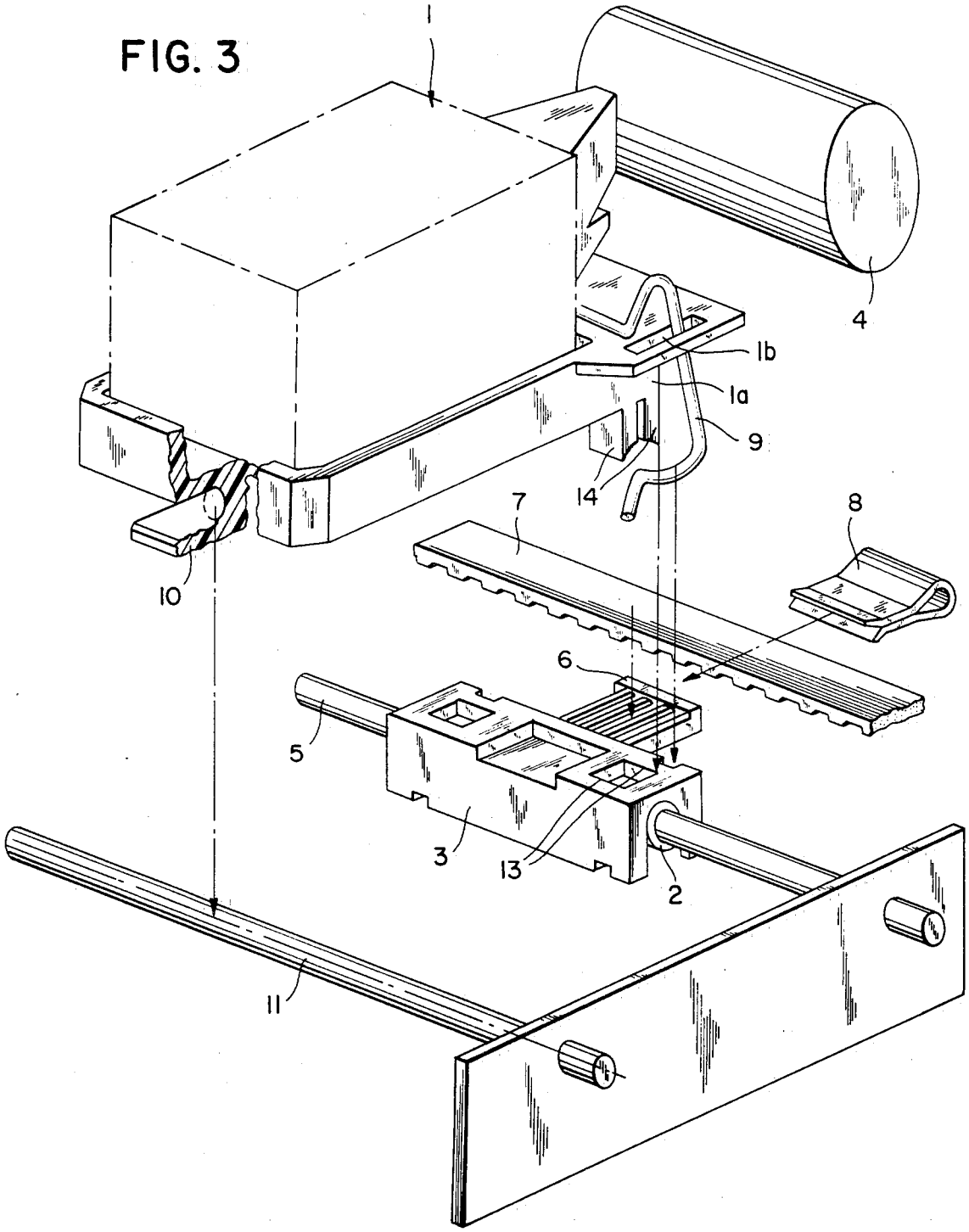

A second latching means in the form of a snap-in clip 9 serves to fasten the print head 1 to the guide bushing 2. The cross-web of the snap-in clip 9 is held positively in the cross-bar 1*a* print head 1, whereas its two legs are freely accessible at both sides of the print head. In order to connect the print head to the guide device, the print head 1 is provided with a fork-like guide projection 10 which is first plugged onto a second guide rail 11 and positioned with respect to the support mount 3. To this end, and as illustrated in FIG. 2, the print head 1 exhibits appropriately-shaped latch pieces 14 depending from the cross-bar 1*a*. In order to guarantee a particularly reliable positioning, at least two latch openings and two latch pieces are provided. When the print head 1 is placed on the second guide rail 11 and is then pivoted down, the latch pieces 14 engage into the latch openings 13 and are reliably guided until they rest against the guide bushing 2, the latch pieces 14 being matched to the shape of the guide bushing 2. The print head 1 is thus reliably and precisely positioned by way of the guide projection 10 plugged onto the second guide rail 11, on the one hand, and by way of the first latching elements 14 introduced into and engaged in the second latch elements 13, on the other hand.

The snap-in clip 9 secured to the print head 1 is then snapped over the guide bushing 2. A supporting nonpositive lock between the print head 1 and the guide bushing 2 exists as a result of this engagement. An accurate fixing of the print head 1 in the previously-set reference position is guaranteed on the basis of this sandwiching, nonpositive latch connection by the snap-in clip 9 to the left and to the right of the support mount. The print head 1 therefore accurately follows the movements of the guide bushing 2.

The projecting ends 12 of the snap-in clip 9 enables a simple and fast closing and opening of this connection and thereby facilitates the replacement of the print head. This occurs in a simple manner by manually removing the snap-in clip 9. After the snap-in clip 9 has been released, the print head 1 can be pivoted up and be removed from the second guide rail 11. Since the electrical connection between the control parts of the printer device and the print head 1 occurs by way of a pluggable, flexible cable, the only thing still required is an unplugging of the plug connection. This replacement of the print head that can be very simply and very quickly implemented allows, for example, an ink jet head to be inserted instead of a wire matrix printing head.

Although we have described our invention by reference to a particular illustrative embodiment thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. Apparatus for guiding a print head parallel to and facing a platen, comprising:

first and second guide rails extending parallel to the platen;

a fork-shape guide projection on the print head for receiving said first guide rail, said guide projection pivotal about and slidably movable along said first guide rail;

a guide bushing slidably mounted on and movable along said second guide rail;

a support mount seating said guide bushing therein;

connecting means for connecting said support mount to a traction device;

first latching means for accurately positioning the print head with respect to said support mount including first latching elements carried on the print head and second latch elements carried on said support mount, said first and second latch elements engaging when aligned and the print head is pivoted towards said support mount; and second latching means carried by the print head and releasably engageable with said guide bushing.

2. The apparatus of claim 1, wherein:

said first latching elements comprise projections extending from the print head; and said second latching means comprises bores for receiving said projections.

3. The apparatus of claim 2, wherein:

said projections include distal ends shaped complemental to and engaging said guide bushing.

4. The apparatus of claim 1, wherein:

said second latching means comprises a cross-bar pivotally secured to the print head and a pair of resilient legs connected to said cross-bar, and each leg shaped to snap about and partially embrace said guide bushing.

5. The apparatus of claim 4, wherein:

each of said legs comprises a free end which is accessible as a release handle.

6. The apparatus of claim 1, wherein:

said guide bushing comprises a pair of glide surfaces.

7. The apparatus of claim 6, wherein:

said guide bushing is bronze.

8. The apparatus of claim 1, wherein:

said connecting means is a clip.

9. The apparatus of claim 1, wherein:

said support mount comprises a plastic body.

* * * * *